US006248022B1

(12) United States Patent
Steyn

(10) Patent No.: US 6,248,022 B1
(45) Date of Patent: Jun. 19, 2001

(54) GOLF PUTT IMPROVEMENT SYSTEM

(76) Inventor: Cornelius Petrus Steyn, P.O.Box 197, Sedgefield (ZA), 6573

( * ) Notice: Subject to any disclaimer, the term of this patent is extended or adjusted under 35 U.S.C. 154(b) by 0 days.

(21) Appl. No.: 09/328,992

(22) Filed: Jun. 10, 1999

(51) Int. Cl.[7] ..... A63B 67/02; A63B 69/36

(52) U.S. Cl. ..... 473/162; 473/164; 473/174; 473/157

(58) Field of Search ..... 473/150, 157–166, 473/167–197, 164

(56) References Cited

U.S. PATENT DOCUMENTS

| | | | | |
|---|---|---|---|---|
| 3,424,464 | * | 1/1969 | Greenhouse | 273/178 |
| 4,886,274 | * | 12/1989 | Park | 273/176 |
| 4,934,704 | * | 6/1990 | Mazer | 273/176 |
| 5,720,667 | * | 2/1998 | Tu | 473/162 |
| 6,001,033 | * | 12/1999 | Tucker | 473/409 |

* cited by examiner

*Primary Examiner*—Jeanette Chapman
*Assistant Examiner*—Such Varma

(57) ABSTRACT

A golf practice system is provided including a supporting surface having at least one set of concentric rings. Also included is a base positioned on the supporting surface in spaced relationship with the concentric rings.

9 Claims, 2 Drawing Sheets

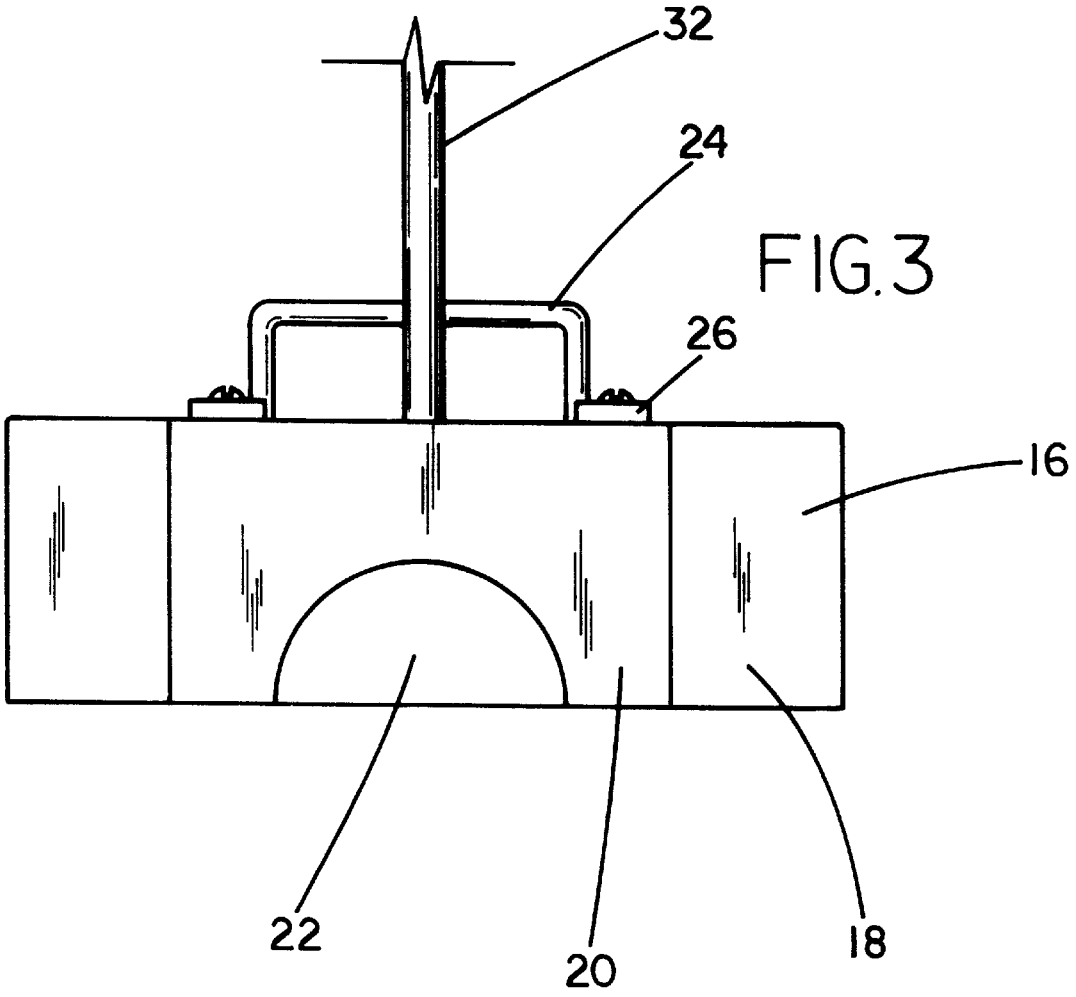
FIG. 3
FIG. 4
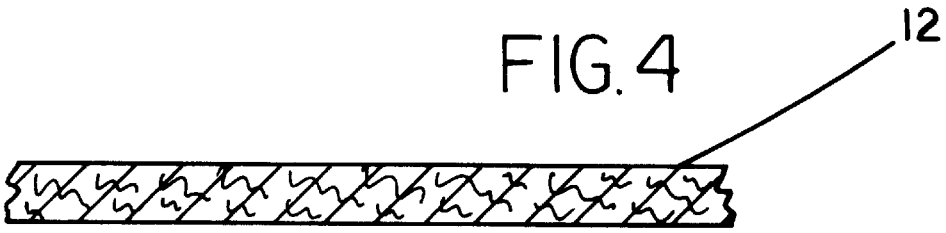

GOLF PUTT IMPROVEMENT SYSTEM

BACKGROUND OF THE INVENTION

1. Field of the Invention

The present invention relates to golf swing improving devices and more particularly pertains to a new golf putt improvement system for practicing putting a golf ball and teaching a user where the "sweet spot" of the golf club resides.

2. Description of the Prior Art

The use of golf swing improving devices is known in the prior art. More specifically, golf swing improving devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,796,434; U.S. Pat. No. 4,368,888; U.S. Pat. No. 1,771,466; U.S. Pat. No. 5,435,560; U.S. Pat. No. Des. 251,863; and U.S. Pat. No. 5,282,626.

In these respects, the golf putt improvement system according to the present invention substantially departs from the conventional concepts and designs of the prior art, and in so doing provides an apparatus primarily developed for the purpose of practicing putting a golf ball and teaching a user where the "sweet spot" of the golf club resides.

SUMMARY OF THE INVENTION

In view of the foregoing disadvantages inherent in the known types of golf swing improving devices now present in the prior art, the present invention provides a new golf putt improvement system construction wherein the same can be utilized for practicing putting a golf ball and teaching a user where the "sweet spot" of the golf club resides.

The general purpose of the present invention, which will be described subsequently in greater detail, is to provide a new golf putt improvement system apparatus and method which has many of the advantages of the golf swing improving devices mentioned heretofore and many novel features that result in a new golf putt improvement system which is not anticipated, rendered obvious, suggested, or even implied by any of the prior art golf swing improving devices, either alone or in any combination thereof.

To attain this, the present invention generally comprises a mat with a planar rectangular configuration and constructed from artificial turf. As shown in FIG. 1, the mat has a top face with three sets of concentric rings equally spaced along a longitudinal bisecting line of the mat. Such sets of rings are preferably positioned between a first end edge of the mat and a point ¾ a length of the mat from the first end edge. Each set of concentric rings has at least three spaced concentrically aligned rings the outermost of which having a diameter less that about ⅓ a width of the mat. While not shown, the rings are each indicative of a unique score amount. Next provided is a solid base having a generally rectangular configuration with a planar top face, a planar bottom face and a periphery. This periphery is defined by a pair of elongated side faces and a pair of short end faces. A first one of the end faces has a pair of beveled corners each with a width about ½ that of a central planar region of the first end face between the beveled corners. As shown in FIG. 3, the central planar region has a semicircular marking positioned thereon with lower opposite ends coincident with the beveled corners. FIGS. 1 & 3 both show an inverted U-shaped carrying handle having a pair of ends with apertured outwardly extending lips. Such apertured lips are coupled along a lateral bisecting line of the top face of the base between the side faces thereof. As such, ends of the handle are equally spaced from a longitudinal bisecting line of the base that is defined between the end faces of the base. FIG. 1 shows a pair of hemispherical recesses formed in the top face of the base along a line in parallel with the lateral bisecting line and spaced between the handle and the first end face of the base. Ideally, the recesses are equally spaced from the longitudinal bisecting line of the base. In use, the recesses are adapted for supporting a pair of golf balls thereon. Further included is a vertically oriented cylindrical bore formed in the top face of the base along the longitudinal bisecting line of the base. In the preferred embodiment, the cylindrical bore is situated between the hemispherical recesses and the first end face of the base. As such, the cylindrical bore is adapted for removably receiving a flag post therein having a flexible upper portion mounted thereon. Finally, a putter recess is provided with a rectangular configuration formed in line with the longitudinal bisecting line of the base. Further, such recess is positioned between the handle and a second one of the end faces of the base. The recess is thus adapted for receiving a head of a putter therein. As such, a handle of the putter extends upwardly in parallel relationship with the flag post. In use, the block is removably positioned on the top face of the mat adjacent a second end edge thereof. As shown in FIG. 1, the central planar region of the first end face of the base faces the sets of concentric rings.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf putt improvement system apparatus and method which has many of the advantages of the golf swing improving devices mentioned heretofore and many novel features that result in a new golf putt improvement system which is not anticipated, rendered obvious, suggested, or even implied by any of the prior art golf swing improving devices, either alone or in any combination thereof.

It is another object of the present invention to provide a new golf putt improvement system which may be easily and efficiently manufactured and marketed.

It is a further object of the present invention to provide a new golf putt improvement system which is of a durable and reliable construction.

An even further object of the present invention is to provide a new golf putt improvement system which is susceptible of a low cost of manufacture with regard to both materials and labor, and which accordingly is then susceptible of low prices of sale to the consuming public, thereby making such golf putt improvement system economically available to the buying public.

Still yet another object of the present invention is to provide a new golf putt improvement system which provides in the apparatuses and methods of the prior art some of the advantages thereof, while simultaneously overcoming some of the disadvantages normally associated therewith.

Still another object of the present invention is to provide a new golf putt improvement system for practicing putting a golf ball and teaching a user where the "sweet spot" of the golf club resides.

Even still another object of the present invention is to provide a new golf putt improvement system that includes a supporting surface having at least one set of concentric rings. Also included is a base positioned on the supporting surface in spaced relationship with the concentric rings.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an end view of base of the present invention.

FIG. 4 is a vertical cross-sectional view of the mat of the present invention taken along line 4—4 shown in FIG. 1.

DESCRIPTION OF THE PREFERRED EMBODIMENT

Figure 1:
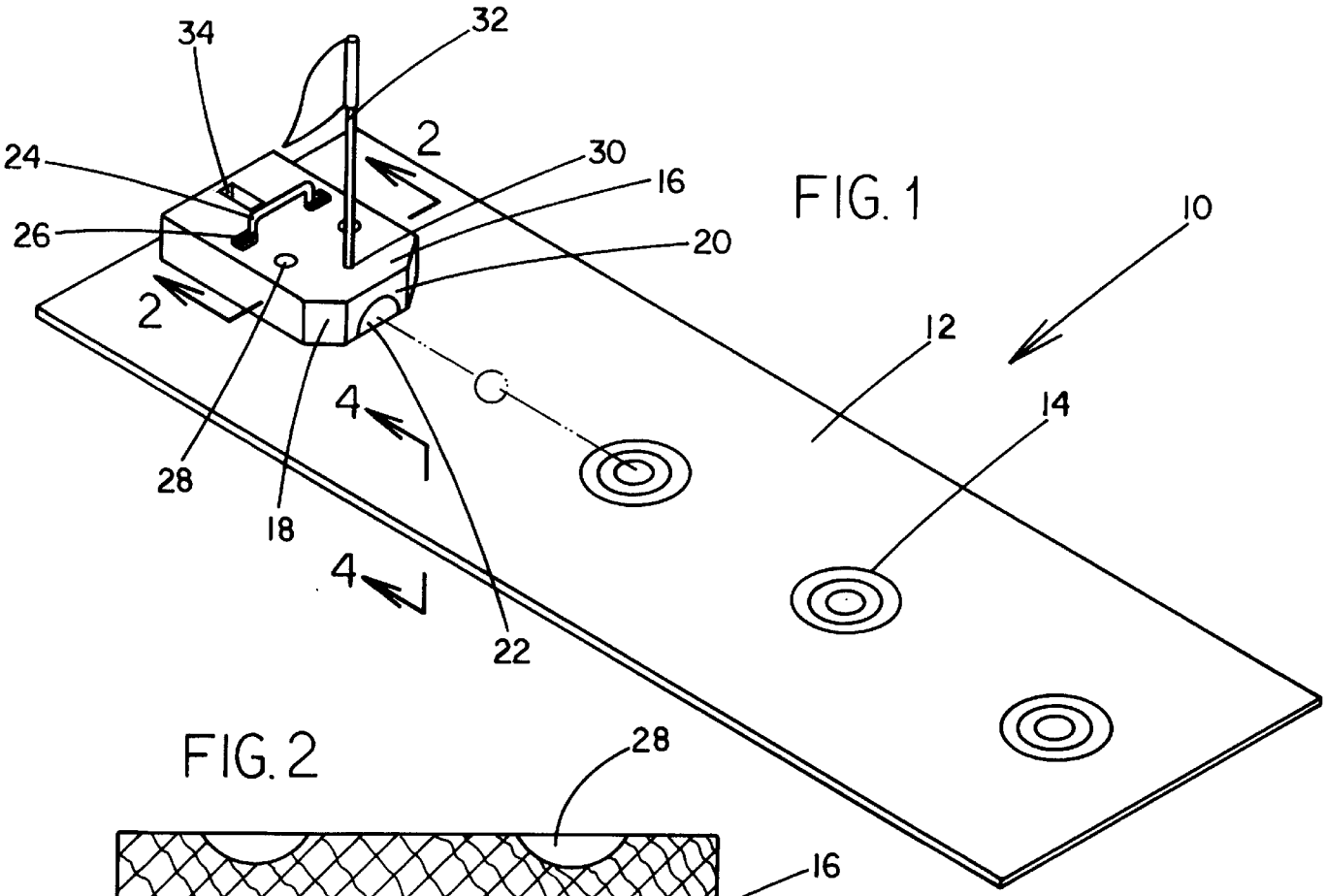
FIG. 1 is a perspective view of a new golf putt improvement system according to the present invention.
Figure 2:
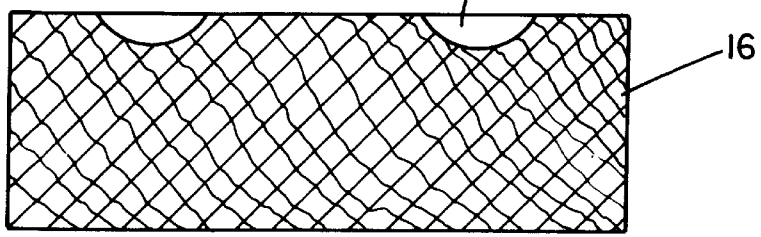
FIG. 2 is a side cross-sectional view of the base of the present invention taken along line 2—2 shown in FIG. 1.

With reference now to the drawings, and in particular to FIGS. 1 through 4 thereof, a new golf putt improvement system embodying the principles and concepts of the present invention and generally designated by the reference numeral 10 will be described.

The present invention, designated as numeral 10, includes a mat 12 with a planar rectangular configuration and constructed from artificial turf. As shown in FIG. 1, the mat has a top face with three sets of concentric rings 14 equally spaced along a longitudinal bisecting line of the mat. Such sets of rings are preferably positioned between a first end edge of the mat and a point ¾ a length of the mat from the first end edge. Each set of concentric rings has at least three spaced concentrically aligned rings the outermost of which having a diameter less that about ⅓ a width of the mat. While not shown, the rings are each indicative of a unique score amount. For example, the inner circle has an associated score of 1, a second innermost circle has an associated score of 2, a third innermost circle has an associated score of 3, and an area outside the circles has an associated score of 4.

Next provided is a solid base 16 having a generally rectangular configuration with a planar top face, a planar bottom face and a periphery. This periphery is defined by a pair of elongated side faces and a pair of short end faces. A first one of the end faces has a pair of beveled corners 18 each with a width about ½ that of a central planar region 20 of the first end face between the beveled corners. Such central planar region is preferably equipped with a width equal to that of a standard golf hole. As shown in FIG. 3, the central planar region has a semicircular marking 22 positioned thereon with lower opposite ends coincident with the beveled corners.

FIGS. 1 & 3 both show an inverted U-shaped carrying handle 24 having a pair of ends with apertured outwardly extending lips 26. Such apertured lips are coupled along a lateral bisecting line of the top face of the base between the side faces thereof. As such, ends of the handle are equally spaced from a longitudinal bisecting line of the base that is defined between the end faces of the base.

FIG. 1 shows a pair of hemispherical recesses 28 formed in the top face of the base along a line in parallel with the lateral bisecting line and spaced between the handle and the first end face of the base. Ideally, the recesses are equally spaced from the longitudinal bisecting line of the base. In use, the recesses are adapted for supporting a pair of golf balls thereon.

Further included is a vertically oriented cylindrical bore 30 formed in the top face of the base along the longitudinal bisecting line of the base. In the preferred embodiment, the cylindrical bore is situated between the hemispherical recesses and the first end face of the base. As such, the cylindrical bore is adapted for removably receiving a flag post 32 therein having a flexible upper portion mounted thereon.

Finally, a putter recess 34 is provided with a rectangular configuration formed in line with the longitudinal bisecting line of the base. Further, such recess is positioned between the handle and a second one of the end faces of the base. The recess is thus adapted for receiving a head of a putter therein. As such, a handle of the putter extends upwardly in parallel relationship with the flag post.

In use, the block is removably positioned on the top face of the mat adjacent a second end edge thereof. As shown in FIG. 1, the central planar region of the first end face of the base faces the sets of concentric rings. Ideally, the sets of rings are spaced 3, 6 & 9 feet from the block.

The method associated with the present invention will now be set forth. First, a user places a golf ball behind a selected one of the sets of concentric rings. Thereafter, the user putts a golf ball towards the base for deflecting the same therefrom. Next, a score is determined based on which one of the concentric rings the golf ball stops after being deflected. Note the scoring method set forth hereinabove. The object of the method is to score a minimum amount of points. During play, a user thus practices putting a golf ball and is taught where the "sweet spot" of the golf club resides.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf practice system comprising, in combination:

a mat with a planar rectangular configuration and constructed from artificial turf, the mat having a top face with three sets of concentric rings equally spaced along a longitudinal bisecting line of the mat between a first end edge of the mat and a point ¾ a length of the mat from the first end edge, each set of concentric rings having at least three spaced concentrically aligned rings the outermost of which having a diameter less that about ⅓ a width of the mat;

a solid base having a generally rectangular configuration with a planar top face, a planar bottom face and a periphery defined by a pair of elongated side faces and a pair of short end faces, a first one of the end faces having a pair of beveled corners each with a width about ½ that of a central planar region of the first end face between the beveled corners, the central planar region having a semicircular marking positioned thereon with lower opposite ends coincident with the beveled corners;

an inverted U-shaped carrying handle having a pair of ends with apertured outwardly extending lips coupled along a lateral bisecting line of the top face of the base between the side faces thereof, wherein ends of the handle are equally spaced from a longitudinal bisecting line of the base that is defined between the end faces of the base;

a pair of hemispherical recesses formed in the top face of the base along a line in parallel with the lateral bisecting line and spaced between the handle and the first end face of the base, wherein the recesses are equally spaced from the longitudinal bisecting line of the base;

a vertically oriented cylindrical bore formed in the top face of the base along the longitudinal bisecting line of the base and between the hemispherical recesses and the first end face of the base for removably receiving a flag post therein having a flexible upper portion mounted thereon; and a putter recess with a rectangular configuration formed in line with the longitudinal bisecting line of the base and between the handle and a second one of the end faces of the base for receiving a head of a putter therein such that a handle of the putter extends upwardly in parallel relationship with the flag post;

wherein the block is removably positioned on the top face of the mat adjacent a second end edge thereof with central planar region of the first end face of the base facing the sets of concentric rings.

2. A golf practice system comprising:

a mat with a planar rectangular configuration, the mat having a top face with three sets of concentric rings equally spaced along a longitudinal bisecting line of the mat between a first end edge and a second end edge of the mat, each set of concentric rings having at least three spaced concentrically aligned rings; and a base positioned on the mat in spaced relationship with the concentric rings.

3. A golf practice system as set forth in claim 2 wherein the base has a central planar region flanked by a pair of beveled corners, wherein the central planar region has as its normal a line that passes through a center of the concentric rings.

4. A golf practice system as set forth in claim 2 wherein the base has a handle mounted thereon.

5. A golf practice system as set forth in claim 2 wherein the base has a flag removably mounted thereon.

6. A golf practice system as set forth in claim 2 wherein at least one recess is formed in the base for supporting a golf ball therein.

7. A golf practice system as set forth in claim 2 wherein a recess is formed in the base for receiving a head of a putter.

8. A golf practice system as set forth in claim 2 wherein a semicircular marking is positioned on the base which is representative of a hole.

9. A golf practice system comprising:

a mat having a top face with artificial turf and three sets of concentric rings equally spaced along a longitudinal line extending between a first end edge and a second end edge of the mat, each set of concentric rings having a plurality of spaced concentrically aligned rings;

a base having a top face, a bottom face and a periphery defined by a pair of side faces and a pair of end faces, a first end face having a semicircular marking positioned thereon;

a carrying handle having a pair of ends coupled to the top face of the base between the side faces thereof;

a pair of hemispherical recesses formed in the top face of the base;

a bore formed in the top face of the base, a flag post having a lower portion removably received in the bore and having a flexible upper portion;

a putter recess formed in the base for receiving a head of a putter therein such that a handle of the putter extends upwardly in parallel relationship with the flag post;

wherein the block is removably positioned on the top face of the mat adjacent the second end edge thereof with the first end face of the base facing the sets of concentric rings.

* * * * *